US006615801B1

(12) United States Patent
Zdroik

(10) Patent No.: US 6,615,801 B1
(45) Date of Patent: Sep. 9, 2003

(54) FUEL RAIL PULSE DAMPER

(75) Inventor: Michael J. Zdroik, Metamora, MI (US)

(73) Assignee: Millennium Industries Corp., Cass City, MI (US)

( * ) Notice: Subject to any disclaimer, the term of this patent is extended or adjusted under 35 U.S.C. 154(b) by 0 days.

(21) Appl. No.: 10/137,532

(22) Filed: May 2, 2002

(51) Int. Cl.[7] ..... F02M 41/00
(52) U.S. Cl. ..... 123/467; 123/447; 123/456
(58) Field of Search ..... 123/467, 468, 123/469, 470, 447, 456

(56) References Cited

U.S. PATENT DOCUMENTS

| | | | | | |
|---|---|---|---|---|---|
| 4,519,368 | A | * | 5/1985 | Hudson, Jr. | 123/468 |
| 4,601,275 | A | | 7/1986 | Weinand | |
| 4,649,884 | A | | 3/1987 | Tuckey | |
| 4,660,524 | A | * | 4/1987 | Bertsch et al. | 123/468 |
| 5,080,069 | A | * | 1/1992 | Hudson et al. | 123/456 |
| 5,311,850 | A | * | 5/1994 | Martin | 123/456 |
| 5,373,824 | A | * | 12/1994 | Peters et al. | 123/527 |
| 5,456,233 | A | * | 10/1995 | Felhofer | 123/447 |
| 5,471,962 | A | * | 12/1995 | Nakashima et al. | 123/456 |
| 5,505,181 | A | | 4/1996 | McRae et al. | |
| 5,718,206 | A | * | 2/1998 | Sawada et al. | 123/470 |
| 5,782,222 | A | * | 7/1998 | Morris et al. | 123/456 |
| 5,845,621 | A | | 12/1998 | Robinson et al. | |
| 5,894,861 | A | | 4/1999 | Lorraine | |
| 5,896,843 | A | | 4/1999 | Lorraine | |
| 6,135,092 | A | | 10/2000 | Schaenzer et al. | |
| 6,205,979 | B1 | | 3/2001 | Sims, Jr. et al. | |
| 6,418,910 | B1 | | 7/2002 | Nally et al. | |
| 2002/0043249 | A1 | | 4/2002 | Lee et al. | |
| 2002/0108660 | A1 | | 8/2002 | Braun et al. | |

FOREIGN PATENT DOCUMENTS

| | | |
|---|---|---|
| JP | 9-157090 | 6/1997 |

* cited by examiner

*Primary Examiner*—Carl S. Miller
(74) *Attorney, Agent, or Firm*—Dykema Gossett PLLC

(57) ABSTRACT

A fuel rail is provided for delivering fuel to a plurality of fuel injectors for a reciprocating piston internal combustion engine. The fuel rail includes a sealed housing having an inlet for receiving fuel, the housing having at least first and second injector outlets for delivering fuel to fuel injectors. The fuel rail also includes first and second filling chambers formed within said housing fluidly connected with respective first and second injector outlets. A reserve pump chamber is provided which is fluidly connected with each said filling chamber, the reserve pump chamber has a volume approximately at least equal to or greater than a volume of one of the filling chambers. The reserve pump chamber dampens pressure pulsations generated in one of the filling chambers from progression to another filling chamber.

21 Claims, 3 Drawing Sheets

FUEL RAIL PULSE DAMPER

FIELD OF THE INVENTION

The field of the present invention is fuel rails for internal combustion engines and in particular, fuel rails for reciprocating piston, spark-ignited internal combustion engines.

BACKGROUND OF THE INVENTION

In the past three decades, there have been major technological efforts to increase the fuel efficiency of automotive vehicles. One technical trend to improve fuel efficiency has been to reduce the overall weight of the vehicle. A second trend to improve fuel efficiency has been to improve the aerodynamic design of a vehicle to lower its aerodynamic drag. Still another trend is to address the overall fuel efficiency of the engine.

Prior to 1970, the majority of production vehicles with a reciprocating piston gasoline engine had a carburetor fuel supply system in which gasoline is delivered via the engine throttle body and is therefore mixed with the incoming air. Accordingly, the amount of fuel delivered to any one cylinder is a function of the incoming air delivered to a given cylinder. Airflow into a cylinder is effected by many variables including the flow dynamics of the intake manifold and the flow dynamics of the exhaust system.

To increase fuel efficiency and to better control exhaust emissions, many vehicle manufacturers went to port fuel injection systems, where the carburetor was replaced by a fuel injector that injected the fuel into a port which typically served a plurality of cylinders. Although port fuel injection is an improvement over the prior carburetor fuel injection system, it is still desirable to further improve the control of fuel delivered to a given cylinder. In a step to further enhance fuel delivery, many spark ignited gasoline engines have gone to a system wherein there is supplied a fuel injector for each individual cylinder. The fuel injectors receive their fuel from a fuel rail, which is typically connected with all or half of the fuel injectors on one bank of an engine. Inline 4, 5 and 6 cylinder engines typically have one bank. V-block type 6, 8, 10 and 12 cylinder engines have two banks.

One critical aspect of a fuel rail application is the delivery of a precise amount of fuel at a precise pressure. In an actual application, the fuel is delivered to the rail from the fuel pump in the vehicle fuel tank. At an engine off condition, the pressure within the fuel rail is typically 45 to 60 psi. When the engine is started, a typical injector firing of 2–50 milligrams per pulse momentarily depletes the fuel locally in the fuel rail. Then the sudden closing of the injector creates a pressure pulse back into the fuel rail. The injectors will typically be open 1.5–20 milliseconds within a period of 10–100 milliseconds.

The opening and closing of the injectors creates pressure pulsations (typically 4–10 psi peak-to-peak) up and down the fuel rail, resulting in an undesirable condition where the pressure locally at a given injector may be higher or lower than the injector is ordinarily calibrated to. If the pressure adjacent to the injector within the fuel rail is outside a given calibrated range, then the fuel delivered upon the next opening of the injector may be higher or lower than that preferred. Pulsations are also undesirable in that they can cause noise generation. Pressure pulsations can be exaggerated in a returnless delivery system where there is a single feed into the fuel rail and the fuel rail has a closed end point.

To reduce undesired pulsations within the fuel rails, many fuel rails are provided with added pressure dampeners.

Dampeners with elastomeric diaphragms can reduce peak-to-peak pulsations to approximately 1–3 psi. However, added pressure dampeners are sometimes undesirable in that they add extra expense to the fuel rail and also provide additional leak paths in their connection with the fuel rail or leak paths due to the construction of the dampener. This is especially true with new Environmental Protection Agency hydrocarbon permeation standards, which are difficult to satisfy with standard O-ring joints and materials. It is desirable to provide a fuel rail wherein pressure pulsations are reduced while minimizing the need for dampeners.

SUMMARY OF THE INVENTION

To make manifest the above-noted and other manifold desires, a revelation of the present invention is brought forth. In a preferred embodiment, the present invention provides a fuel rail for a plurality of fuel injectors. The fuel rail includes a sealed housing having a fuel inlet and at least two injector outlets. First and second filling chambers are provided which are fluidly communicative with respective injector outlets. A reserve pump chamber is provided having a convergent/divergent fluid communication with each of the filling chambers.

The reserve pump chamber has a volume approximately equal to or greater than the filling chamber volume and preferably twice that of the filling chamber volume. The convergent/divergent fluid connection between the reserve pump chamber and the filling chamber dampens progression of pressure pulsations generated in one filling chamber from going to another filling chamber. The transmission of pressure pulsations via the fuel rail is further hampered by a buffer plate which bifurcates a part of the housing forming a supply chamber on one side and a reserve pump chamber and filling chamber on an opposite side.

Further features and advantages of the present invention will become more apparent to those skilled in the art after a review of the invention as it shown in the accompanying drawings and detailed description.

DETAILED DESCRIPTION OF THE INVENTION

Figure 1:
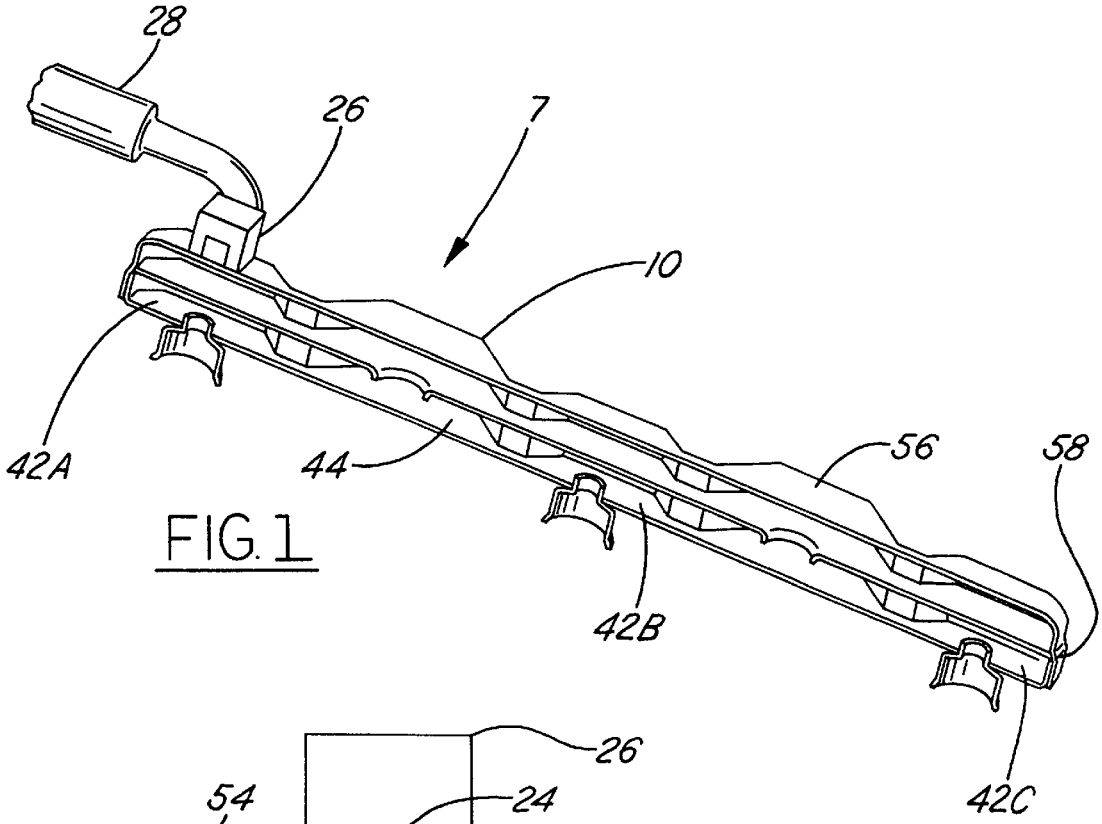
FIG. 1 is a perspective sectional view of a preferred embodiment fuel rail according to the present invention.
Figure 4:
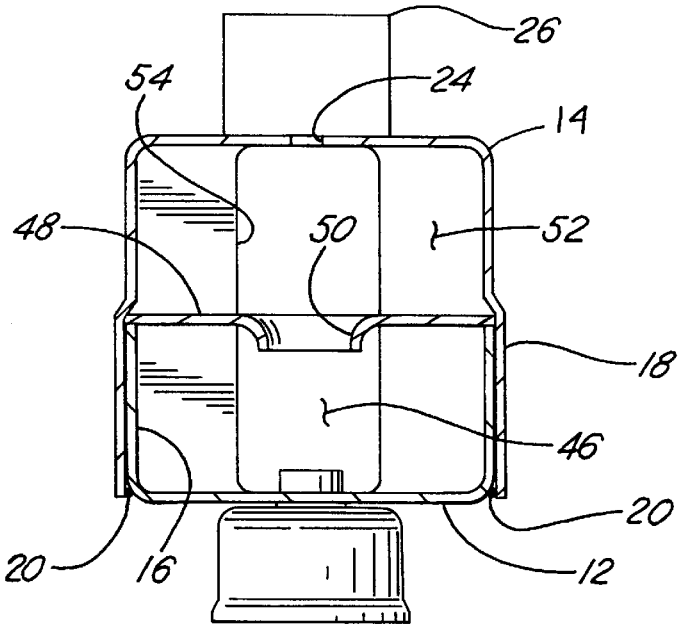
FIG. 4 is a view taken along line 4—4 of FIG. 3.
Figure 2:
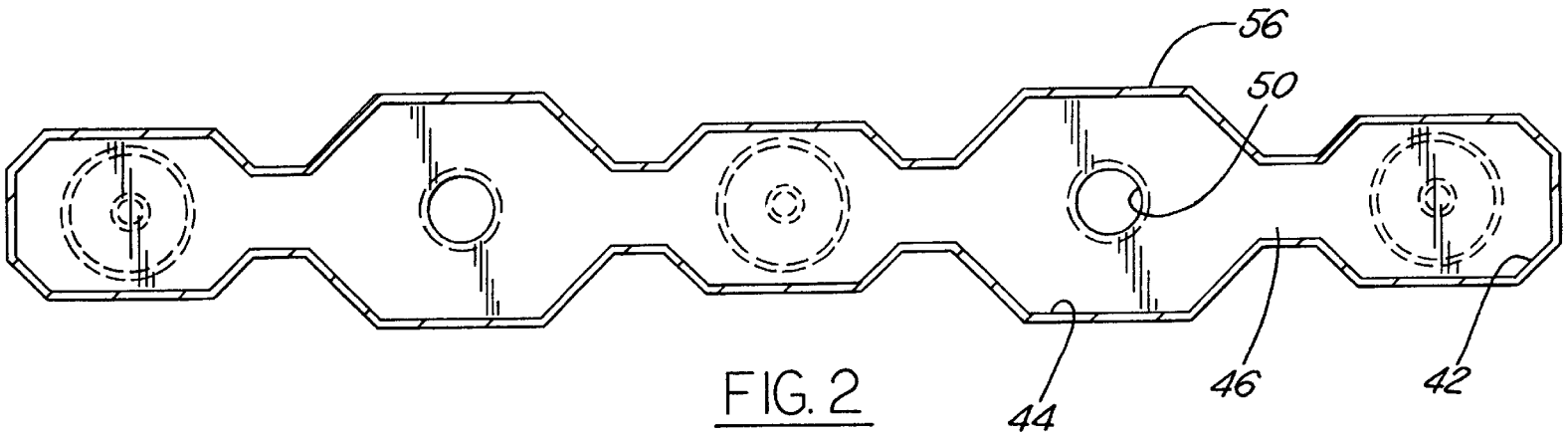
FIG. 2 is a top sectional view of the fuel rail shown in FIG. 1.
Figure 3:
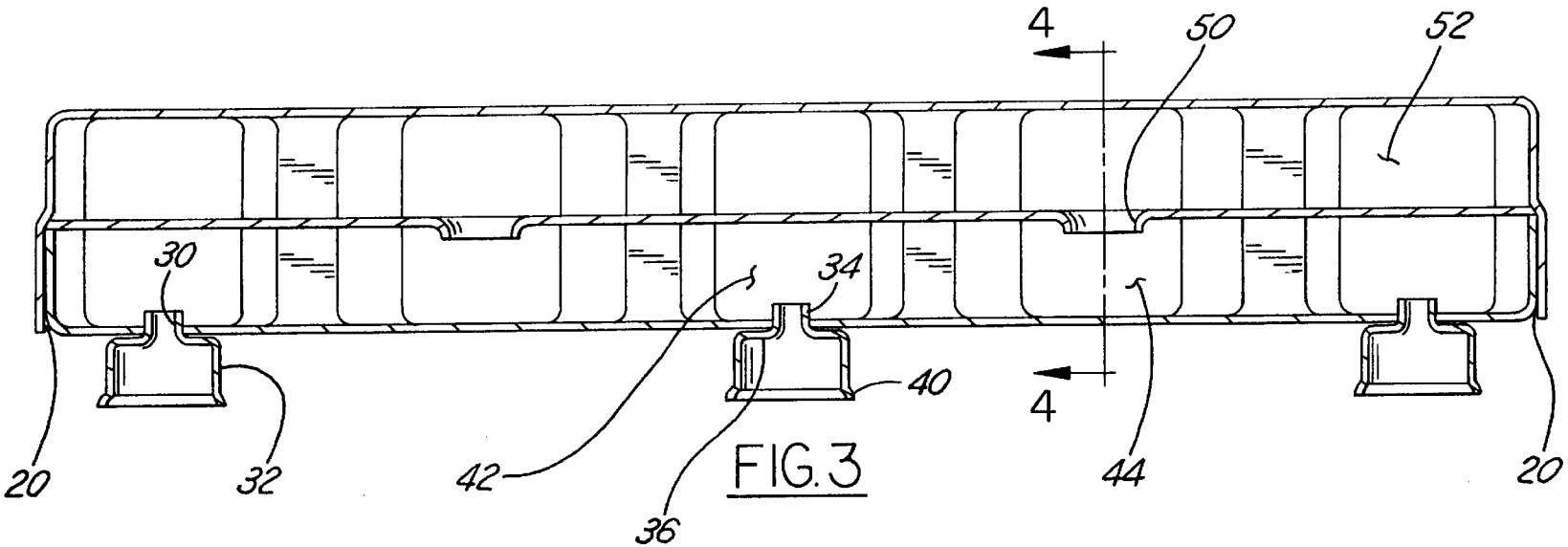
FIG. 3 is a front elevational sectional view of the fuel rail shown in FIG. 1.

Referring to FIGS. 1 through 4, the fuel rail 7 of the present invention has a housing 10. The fuel rail 7 provides fuel for a plurality of gasoline fuel injectors (not shown) in a reciprocating piston, spark-ignited internal combustion engine. The housing is formed by male and female shells provided by a lower stamped member 12 and an upper stamped member 14. The housing stamped members 12, 14 are typically fabricated from low carbon steel or stainless steel sheet metal having a thickness of 0.3–1.0 millimeters. The lower stamped member 12 is generally U-shaped having legs 16. The legs 16 are inserted within overlapping legs 18 of the upper stamped member. A brazing bead 20 seals the lower stamped member and upper stamped member to each other providing the sealing for the housing 10. The sealed housing 10 also has an inlet 24. The inlet orifice is approximately 8 millimeters in diameter. The inlet 24 is encompassed by a pressure fitting 26 which is fluidly connected with a pressurized fuel delivery line 28.

In the embodiment shown, the fuel rail 7 has three injector outlets 30. Brazed or otherwise fixably sealably attached to the injector outlets 30 are three injector cups 32. The injector cups 32 have a fitting portion 34 which extends through the injector outlet 30. The injector cups also have a generally flat annular portion 36 which is integrally joined to the fitting portion 34. The remainder of the injector cups 32 includes a cylindrical portion having a lower flared rim 40.

Fluidly connected with each of the injector outlets 30 is a filling chamber 42. The filling chamber has an approximately 4 cubic centimeter volumetric area, the shape of which is defined by the shape of the housing 7. The filling chamber 42 fluidly communicates with the injector outlets 30 via the fitting portion 34.

The fuel rail 7 has a series of reserve pump chambers 44. The reserve pump chambers 44 have fluid communication with the filling chambers 42 via a convergent/divergent orifice opening 46. The convergent/divergent orifice opening 46 is formed by the shape of the housing 10. Horizontally bifurcating the fuel rail 7 is a buffer plate 48. The buffer plate 48 has a convergent orifice 50, which fluidly connects a supply chamber 52 with the reserve pump chamber 44. The buffer plate 48 is typically biased with one of the stamped members 12, 14 to seal the supply chamber 52 from the reserve pump chamber (with the exception of the orifice 50). The supply chamber 52 is also orificed by a convergent/divergent opening 54, which is formed by the shape of the housing 10.

In operation, pressurized fuel is delivered to the fuel rail at approximately 45 to 60 psi through the pressure fitting 26. The fuel from the pressure fitting 26 enters into the fuel inlet 24. Fuel coming in through the inlet 24 is delivered into the supply chamber 52. The supply chamber 52 has two enlarged portions 56, which are vertically aligned with the reserve pump chambers 44. Pressurized fuel passes through the convergent orifice 50 from the supply chamber 52 into the reserve pump chambers 44. Pressurized fuel from the fuel reserve pump chambers 44 then communicates via the convergent/divergent orifice openings 46 with the filling chambers 42.

Looking at the extreme left filling chamber 42A of FIG. 1, opening of the injector associated therewith will cause the fluid within the filling chamber 42A to be delivered to the injector via the injector outlet 30. The fuel within the adjacent reserve pump chamber 44 passes through the convergent/divergent orifice opening 46, which dampens the resultant pressure spike caused by the opening of the extreme far left injector and dampens any propagation of the pressure spike to the other filling chambers 42. Additionally, since the reserve pump chamber 44 is approximately at least the same and preferably twice the size of the filling chamber 42A, there is further dissipation of pressure pulsations.

The fuel rail 7 as shown is for a V-6 engine and many V-6 engines employ bank-to-bank firing. Accordingly, the next injector which will be opened will be associated with filling chamber 42B. Possible pressure spikes which can be generated by the opening and closing of the injector associated with filling chamber 42B, are further dissipated by the fact that filling chamber 42B has a convergent/divergent orifice opening with two reserve pump chambers 44. Additionally, the buffer plate 48 also hinders the propagation of pressure pulsations. The fuel rail 7 has a closed extreme end 58 since it is of the non-recirculating type of fuel rail. Accordingly, the prevention of pressure pulsations is even more critical. In many applications, the fuel rail 7 can have added pressure dampeners.

Figure 5:
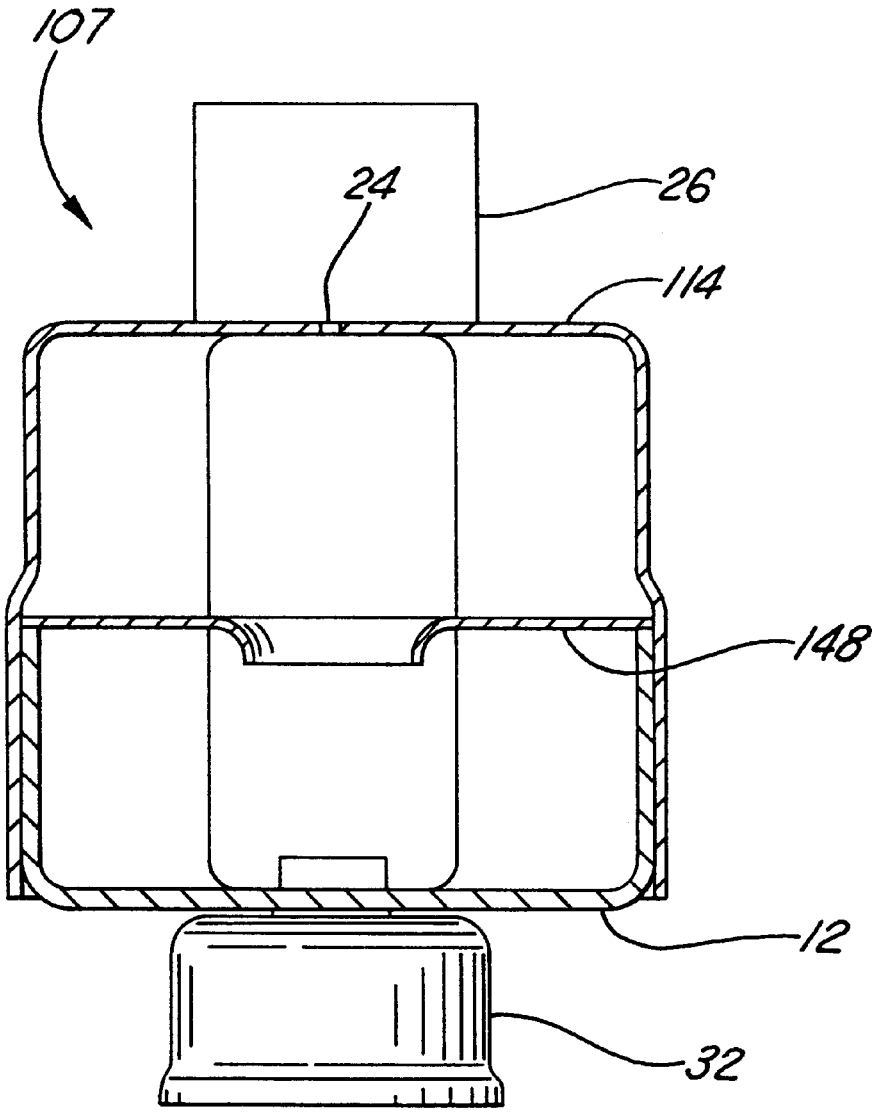
FIG. 5 is a view similar to FIG. 4 of an alternate preferred embodiment of the present invention.

Referring to FIG. 5, with items performing similar functions given identical reference numerals, a fuel rail 107 is provided. Fuel rail 107 is essentially similar to fuel rail 7 with the exception that the upper stamped member 114 is approximately at least 25% thinner than the lower stamped member 12. The lower stamped member 12 will typically be between 0.030 to 0.045 inches in thickness. The upper stamped member 114 and buffer plate 148 will typically be 0.015 to 0.030 inches in thickness. Additionally, the buffer plate 148 is at least 25% thinner than the lower stamped member 12. The upper stamp member 114 and buffer plate 148 act as dampeners to further attenuate any pressure pulsations generated within the filling chambers 42. The more rigid lower stamped member 12 will be connected to the needed brackets on other mounting hardware (not shown).

While preferred embodiments of the present invention have been disclosed, it is to be understood that they have been disclosed by way of example only and that various modifications can be made without departing from the spirit and scope of the invention as it is explained by the following claims.

I claim:

1. A fuel rail for delivering fuel to a plurality of fuel injectors for a reciprocating piston internal combustion engine, comprising:

a sealed housing having an inlet for receiving fuel; said housing having at least first and second injector outlets for delivering fuel to fuel injectors;

first and second filling chambers formed within said housing fluidly connected with respective said first and second injector outlets; and a reserve pump chamber fluidly connected with each of said filling chambers, said reserve pump chamber having a volume approximately at least equal to or greater than a volume of one of said filling chambers, said reserve pump chamber dampening pressure pulsations generated in one of said filling chambers from progression to another of said filling chambers.

2. A fuel rail as described in claim 1, wherein said reserve pump chamber has a volume approximately at least twice a volume of one of said filling chambers.

3. A fuel rail as described in claim 1, having at least one reserve pump chamber fluidly connected with a plurality of filling chambers.

4. A fuel rail as described in claim 1, being a non-recirculation type.

5. A fuel rail as described in claim 1, fabricated from stamped sheet metal.

6. A fuel rail as described in claim 1, wherein said fuel rail is elongated and said reserve pump chamber is fluidly connected to said filling chambers by an orifice formed by a shape of said housing.

7. A fuel rail as described in claim 1, further including a supply chamber fluidly connected with said reserve pump chamber.

8. A fuel rail as described in claim 7, wherein said housing is bifurcated having said supply chamber on one side of said bifurcation.

9. A fuel rail as described in claim 1, wherein said fuel rail is formed by two shells joined together.

10. A fuel rail as described in claim 9, wherein said housing is bifurcated by a buffer plate, and said fuel has a supply chamber on a side of said buffer plate opposite said reserve pump chamber.

11. A fuel rail as described in claim 9, wherein one of said shells is a male member having side portions fitted within side portions of a female member shell.

12. A fuel rail as described in claim 2, wherein said supply chamber has convergent/divergent orifices formed therein by said housing shape.

13. A fuel rail as described in claim 9, wherein one of said shells is at least 25% thinner than said other shell.

14. A fuel rail as described in claim 10, wherein said buffer plate is at least 25% thinner than one of said shells.

15. A non-recirculation type fuel rail for a plurality of fuel injectors, comprising:

a sealed housing having a fuel inlet and at least two injector outlets;

at least first and second filling chambers fluidly connected with respective one of said injector outlets; and a reserve pump chamber being convergent/divergent fluidly connected with each one of said filling chambers.

16. A fuel rail as described in claim 15, wherein said reserve pump chamber has a volume approximately at least equal to or greater than a volume of one of said filling chambers.

17. A fuel rail as described in claim 16, wherein said reserve pump chamber has a volume approximately at least twice a volume of one of said filling chambers.

18. A fuel rail as described in claim 15, having at least one reserve pump chamber fluidly connected with a plurality of filling chambers.

19. A fuel rail as described in claim 15, fabricated from stamped sheet metal.

20. A fuel rail for delivering fuel to a plurality of fuel injectors for a spark-ignited, reciprocating piston internal combustion engine comprising:

a sealed housing having an inlet for receiving fuel and a plurality of injector outlets for delivering fuel to fuel injectors;

filling chambers formed within said housing fluidly connected with said injector outlets;

a reserve pump chamber fluidly connected with each of said filling chambers via a convergent/divergent orifice opening formed by said housing, said reserve pump chamber having a volume approximately at least twice a volume of one of said filling chambers; and a supply chamber fluidly connected with said reserve pump chamber and being bifurcated therefrom and said supply chamber being fluidly connected with said housing inlet.

21. A method for delivering fuel to a plurality of fuel injectors for a reciprocating piston internal combustion engine comprising:

receiving said fuel into an inlet provided in a sealed housing;

delivering said fuel via injector outlets provided in said housing;

fluidly connecting with said injector outlets separated filling chambers;

fluidly connecting with each one of said filling chambers via a convergent/divergent orifice a reserve pump chamber having a volume approximately at least the volume of one of said filling chambers; and dampening pressure pulsations generated in one of said filling chambers by the opening and/or closing of a fuel injector in one of said filling chambers from progression to another said filling chamber.

* * * * *